US010495415B2

(12) United States Patent
Chou et al.

(10) Patent No.: US 10,495,415 B2
(45) Date of Patent: Dec. 3, 2019

(54) SIGHT

(71) Applicants: Sintai Optical (Shenzhen) Co., Ltd., ShenZhen, Guandong Province (CN); Asia Optical Co., Inc., Taichung (TW)

(72) Inventors: Hung-Chi Chou, Taichung (TW); Chia-Kan Chang, Taichung (TW); Sung-Po Cheng, Taichung (TW)

(73) Assignees: SINTAI OPTICAL (SHENZHEN) CO., LTD., Shenzhen, Guandong Province (CN); ASIA OPTICAL CO., INC., Taichung (TW)

( * ) Notice: Subject to any disclaimer, the term of this patent is extended or adjusted under 35 U.S.C. 154(b) by 0 days.

(21) Appl. No.: 16/285,325

(22) Filed: Feb. 26, 2019

(65) Prior Publication Data

US 2019/0285382 A1 Sep. 19, 2019

(30) Foreign Application Priority Data

Mar. 19, 2018 (CN) ..... 2018 1 0222775

(51) Int. Cl.

| | |
|---|---|
| ***G06G 7/80*** | (2006.01) |
| ***F41G 3/08*** | (2006.01) |
| ***F41G 1/38*** | (2006.01) |
| ***F41G 1/54*** | (2006.01) |

(52) U.S. Cl.

CPC ..... *F41G 3/08* (2013.01); *F41G 1/38* (2013.01); *F41G 1/545* (2013.01)

(58) Field of Classification Search

CPC ... F41G 1/38; F41G 1/30; F41G 1/345; F41G 1/473; F41G 1/467; F41G 3/06; G02B 23/14; G02B 27/0172; G02B 7/28

USPC ..... 235/404; 359/399, 422, 557

See application file for complete search history.

(56) References Cited

U.S. PATENT DOCUMENTS

| | | | | |
|---|---|---|---|---|
| 5,913,079 | A * | 6/1999 | Aoyama | G02B 7/28 396/121 |
| 2012/0145785 | A1* | 6/2012 | Scrogin | F41G 1/38 235/404 |
| 2017/0254620 | A1* | 9/2017 | Dasukevich | F41G 1/38 |

* cited by examiner

*Primary Examiner* — Jamara A Franklin

(74) *Attorney, Agent, or Firm* — McClure, Qualey & Rodack, LLP

(57) ABSTRACT

A sight includes an inner lens barrel, a compensating device and a converting unit. The inner lens barrel includes a plurality of lenses constituting an optical axis. The compensating device includes a base, an adjusting unit and an adjusting cap. The adjusting unit is disposed on the base, is penetrated through the base and is placed against the inner lens barrel. The adjusting cap is connected to the adjusting unit, wherein the adjusting cap is rotated for axially moving the adjusting unit, and the inner lens barrel is pushed by the adjusting unit so that the optical axis is shifted. The converting unit is configured to convert shift amount of the optical axis to an electric signal corresponding to number of rotation of the adjusting cap and output the electric signal.

20 Claims, 6 Drawing Sheets

SIGHT

BACKGROUND OF THE INVENTION

Field of the Invention

The invention relates to a sight, and more particularly to a digital sight.

Description of the Related Art

Generally, a sight is usually provided with an elevation or windage compensating mechanism for correcting bullet impact points. During the correction of bullet impact points, the user needs to rotate the compensating mechanism a number of times and may forget the number of rotation that the compensating mechanism has experienced. Therefore, the conventional compensating mechanism is usually provided with a counting ring having a scale, and the user is able to record number of rotation of the compensating mechanism by rotating the counting ring. When the compensating mechanism is rotated by 360 degrees, the user manually rotates the counting ring, so that the scale is adjusted to represent that the number of rotation is increased by 1.

However, with the development of digitization of sight, digitization of recording the number of rotation of the compensating mechanism becomes an important issue.

BRIEF SUMMARY OF THE INVENTION

The invention provides a sight including a compensating device and a converting unit, and the sight is capable of recording number of rotation of the compensating mechanism in digital way through the converting unit.

A sight in accordance with an embodiment of the invention includes an inner lens barrel, a compensating device and a converting unit. The inner lens barrel includes a plurality of lenses, wherein the lenses constitute an optical axis. The compensating device includes a base, an adjusting unit and an adjusting cap. The adjusting unit is disposed on the base, is penetrated through the base and is placed against the inner lens barrel. The adjusting cap is connected to the adjusting unit, wherein the adjusting cap is rotated for axially moving the adjusting unit, and the inner lens barrel is pushed by the adjusting unit so that the optical axis is shifted. The converting unit is configured to convert shift amount of the optical axis to an electric signal corresponding to number of rotation of the adjusting cap and output the electric signal.

In another embodiment, the converting unit is connected to the adjusting unit and is configured to convert axial movement of the adjusting unit to the electric signal.

In yet another embodiment, the converting unit includes a first conductive member and a first resistor, the first conductive member is placed against the first resistor, and a contact point between the first conductive member and the first resistor is changed during the movement of the adjusting unit.

In another embodiment, when the contact point between the first conductive member and the first resistor is changed, the resistance of the first resistor is changed in the range of 0K to 118.8K Ohms.

In yet another embodiment, the adjusting unit includes a transmitting member and an adjusting screw, the first resistor is disposed on the transmitting member, and the first conductive member is connected to the adjusting screw.

In another embodiment, the converting unit further includes a circuit board connected to the adjusting screw, and the first conductive member is fixed on the circuit board.

In yet another embodiment, the converting unit further includes a support base disposed on the adjusting screw and configured to carry the circuit board.

In another embodiment, the converting unit further includes a second conductive member fixed to both the circuit board and the first resistor.

In yet another embodiment, the first conductive member is coil, metallic strip or conductive wire, and the second conductive member is coil, metallic strip or conductive wire.

In another embodiment, the converting unit further includes a sleeve disposed on the transmitting member, and the first resistor is disposed on the sleeve.

In yet another embodiment, the sight further includes a main body, an objective unit, an eyepiece unit, an inner lens barrel and an elastic member. The main body has a frontal end portion and a rear end portion. The objective unit is connected to the frontal end portion. The eyepiece unit is connected to the rear end portion. The inner lens barrel is disposed in the main body, is between the objective unit and the eyepiece unit and includes a plurality of lenses, wherein the objective unit, the inner lens barrel and the eyepiece unit constitute an optical axis. The elastic member is disposed in the main body and is placed against the inner lens barrel. The inner lens barrel is disposed in the main body, between the objective unit and the eyepiece unit. The objective unit, the inner lens barrel and the eyepiece unit constitute the optical axis. The compensating device is disposed on the main body and is placed against the inner lens barrel for adjusting the optical axis.

In another embodiment, the adjusting cap is rotated for axially moving the adjusting unit so as to adjust an angle of the inner lens barrel, and the converting unit is configured to convert variation in the angle of the inner lens barrel to the electric signal.

In yet another embodiment, the sight further includes a main body, wherein the inner lens barrel is disposed in the main body.

In another embodiment, the converting unit includes a first sensor and a second sensor, the first sensor is disposed on the inner lens barrel and is configured to detect the angle of the inner lens barrel and output a first inclination signal, and the second sensor is disposed on the main body and is configured to detect an angle of the main body and output a second inclination signal.

In yet another embodiment, the first sensor and the second sensor are gyros.

In another embodiment, the sight further includes a processing unit, wherein the processing unit is configured to receive the first inclination signal and the second inclination signal for obtaining the angles of the inner lens barrel and the main body, calculate a relative angle and judge the number of rotation of the adjusting cap according to magnitude of the relative angle.

In yet another embodiment, the processing unit subtracts the angle of the main body from the angle of the inner lens barrel for obtaining the relative angle.

In another embodiment, the sight further includes a display unit, wherein the processing unit is configured to control the display unit to display the number of rotation of the adjusting cap.

In yet another embodiment, the sight further includes an objective unit and an eyepiece unit, wherein the main body has a frontal end portion and a rear end portion, the objective unit is connected to the frontal end portion, and the eyepiece unit is connected to the rear end portion.

In another embodiment, the inner lens barrel is between the objective unit and the eyepiece unit and constitutes an optical axis with the objective unit and the eyepiece unit, and the compensating device is disposed on the main body and is placed against the inner lens barrel for adjusting the optical axis.

In yet another embodiment, the sight further includes an elastic member disposed in the main body and placed against the inner lens barrel.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
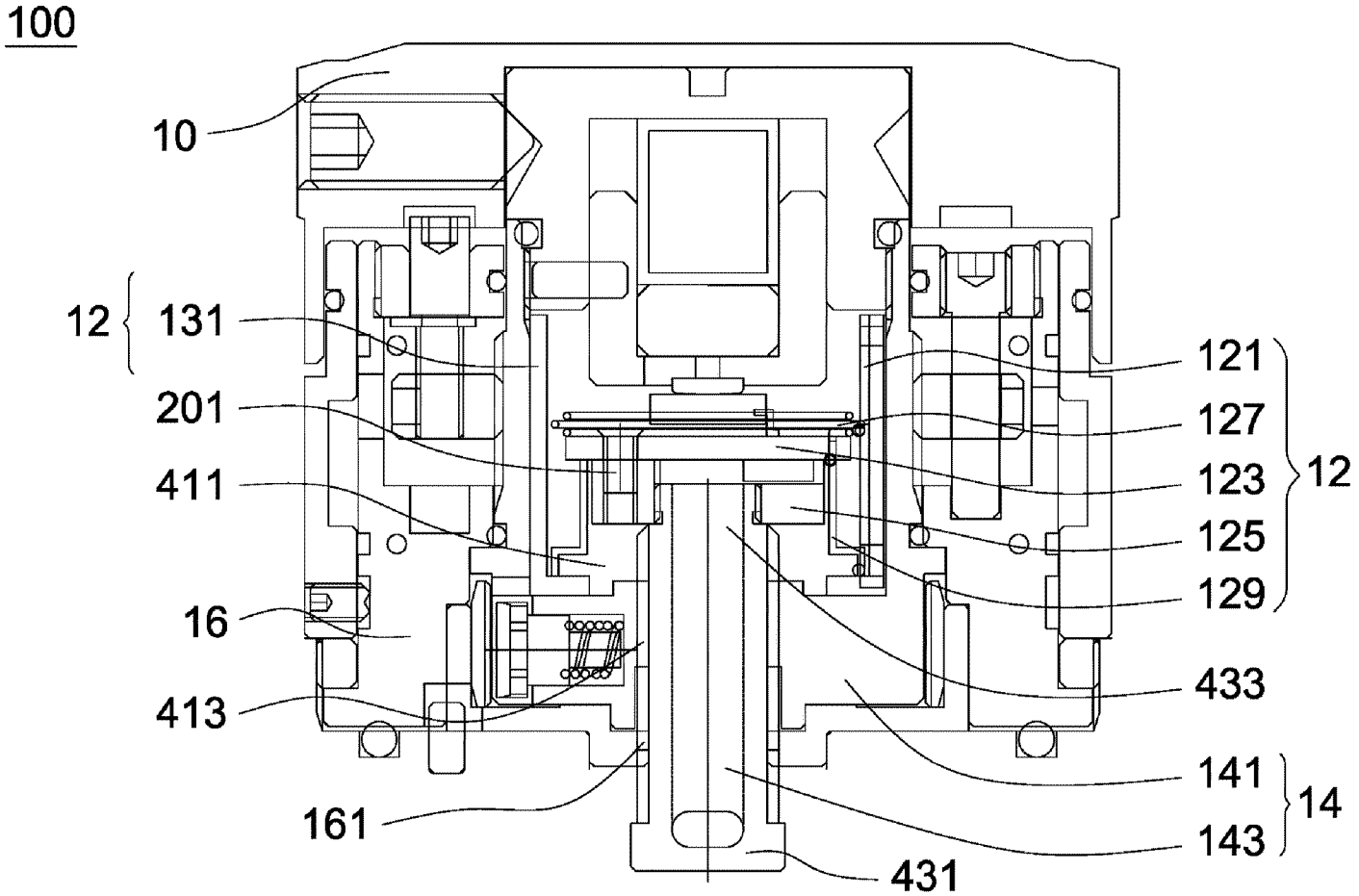
FIG. 1 is a sectional view of a compensating device of a sight in accordance with a first embodiment of the invention.

Referring to FIG. 1, a sight (not shown) in accordance with a first embodiment of the invention includes a main body (not shown), a compensating device 100, an objective unit (not shown), an eyepiece unit (not shown), an inner lens barrel (not shown), a converting unit 12, a display unit 50 (shown in FIG. 3), a processing unit 40 (shown in FIG. 3) and an elastic member (not shown). A user can rotate the compensating device 100 for correcting bullet impact points, the processing unit 40 is configured to judge number of rotation of the compensating device 100 according to an electric signal outputted by the converting unit 12, and the display unit 50 is configured to display the number of rotation for user's reference.

The main body has a frontal end portion and a rear end portion, the objective unit is connected to the frontal end portion, and the eyepiece unit is connected to the rear end portion. The inner lens barrel is disposed in the main body, is between the objective unit and the eyepiece unit, and includes a plurality of lenses (not shown). The objective unit, the inner lens barrel and the eyepiece unit constitute an optical axis (not shown). The elastic member is disposed in the main body and is placed against the inner lens barrel. The compensating device 100 is disposed on the main body, penetrated through the main body and placed against the inner lens barrel so as to adjust the optical axis. In the first embodiment, the compensating device 100 is an elevation compensating device or a windage compensating device, the elevation compensating device is usually disposed on a top side of the main body, and the windage compensating device is usually disposed on a right side or a left side of the main body.

As shown in FIG. 1, the compensating device 100 includes an adjusting cap 10, an adjusting unit 14 and a base 16. The adjusting cap 10 is rotated for rotating and moving the adjusting unit 14. The converting unit 12 is configured to convert movement of the adjusting unit 14 to an electric signal and output the electric signal. The processing unit 40 is configured to judge number of rotation of the adjusting cap 10 according to the electric signal. The display unit 50 is configured to display the number of rotation so as to provide for user's reference.

The base 16 is disposed on the main body and has an adjusting hole 161, wherein the adjusting hole 161 is provided with inner threads (not shown). The adjusting unit 14 is disposed on the base 16, extends through the adjusting hole 161 and penetrates into the main body. The adjusting cap 10 is connected to the adjusting unit 14. The adjusting unit 14 includes a transmitting member 141 and an adjusting screw 143, and the transmitting member 141 is disposed on the base 16 and has an accommodating space 411 and a central hole 413. The adjusting screw 143 is disposed in the central hole 41 and has a first end 431, a second end 433 and outer threads (not shown). The first end 431 extends through the adjusting hole 161 and penetrates into the main body for contacting the inner lens barrel, the second end 433 extends into the accommodating space 411, and the outer threads are configured to engage with the inner threads of the adjusting hole 161.

The converting unit 12 is disposed in the accommodating space 411 and includes a first resistor 121, a circuit board 123, a support base 125, a coil 127, a conductive wire 129 and a sleeve 131. The sleeve 131 is disposed in the accommodating space 411, and the first resistor 121 is fixed on inner circumferential surfaces of the sleeve 131. It is understood that the first resistor 121 can be directly fixed in the accommodating space 411, even if the sleeve 131 is omitted. The support base 125 is disposed on the second end 433 of the adjusting screw 143, the circuit board 123 is fixed on the support base 125 through a screw 201, and the coil 129 is fixed on the circuit board 123 by welding and is placed against the first resistor 121. One end of the conductive wire 129 is fixed to the first resistor 121 by welding, and the other end of the conductive wire 129 is fixed to the circuit board 123 by welding.

Figure 2:
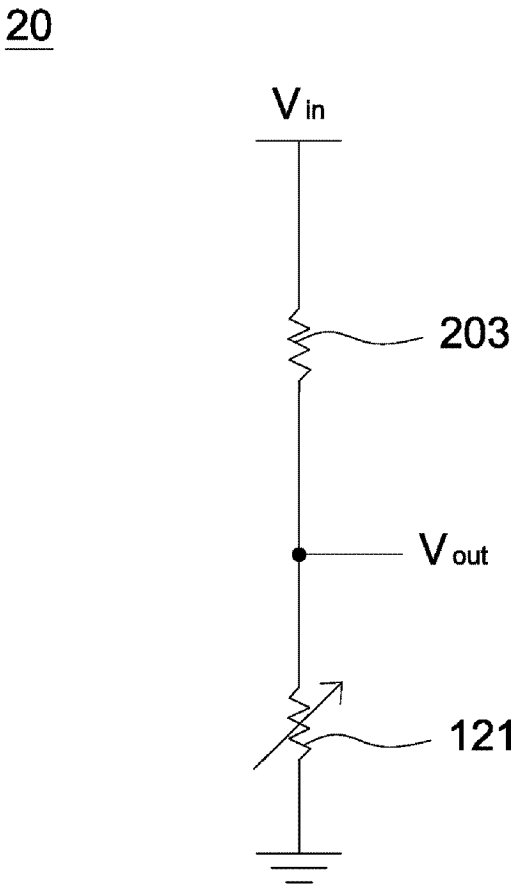
FIG. 2 is a schematic diagram of a bleeder circuit of a converting unit of FIG. 1.

It is worth noting that the first resistor 121 is a variable resistor, and the circuit board 123 includes a second resistor 203 (shown in FIG. 2). Referring to FIG. 2, the first resistor 121, the circuit board 123, the coil 127 and the conductive wire 129 constitute a bleeder circuit 20 after the above-described assembly. A voltage source (not shown), the second resistor 203 and the first resistor 121 are connected in series, and the first resistor 121 is further connected to ground. Then, an output voltage $V_{out}$ (that is, the electric signal) of the bleeder circuit 20 is measured at a node between the first resistor 121 and the second resistor 203. The output voltage $V_{out}$ can be represented by following equation (1):

$V_{out}=V_{in}\times R_{121}/(R_{121}+R_{203})$ . . . (1), wherein $V_{in}$ is input voltage of the voltage source, $R_{121}$ is resistance of the first resistor 121, and $R_{203}$ is resistance of the second resistor 203.

In the first embodiment, the input voltage $V_{in}$ is substantially 1.8±5% volts, that is, the input voltage $V_{in}$ substantially ranges from 1.71 to 1.89 volts. The resistance $R_{121}$ of the first resistor 121 substantially ranges from OK to 118.8K Ohms, and the resistance $R_{203}$ of the second resistor 203 is substantially 22K±1% Ohms, that is, the resistance of the second resistor 203 substantially ranges from 21.78K to 22.22K Ohms. After the calculation set forth in equation (1), it is obtained that the output voltage $V_{out}$ substantially ranges from 0 to 1.5972 volts.

During correction of bullet impact points through the compensating device 100, the adjusting cap 10 is rotated in a circumferential direction for rotating the adjusting unit 14 with respect to the base 16, so that the adjusting screw 143 is moved in an axial direction with respect to the base 16. Meanwhile, the circuit board 123 indirectly carried by the adjusting screw 143 is moved in the axial direction, so as to change a contact point between the coil 127 and the first resistor 121. After the contact point between the coil 127 and the first resistor 121 is changed, the resistance $R_{121}$ of the first resistor 121 is changed in the range of 0K to 118.8K Ohms, so that the output voltage $V_{out}$ of the bleeder circuit 20 is changed.

Figure 3:
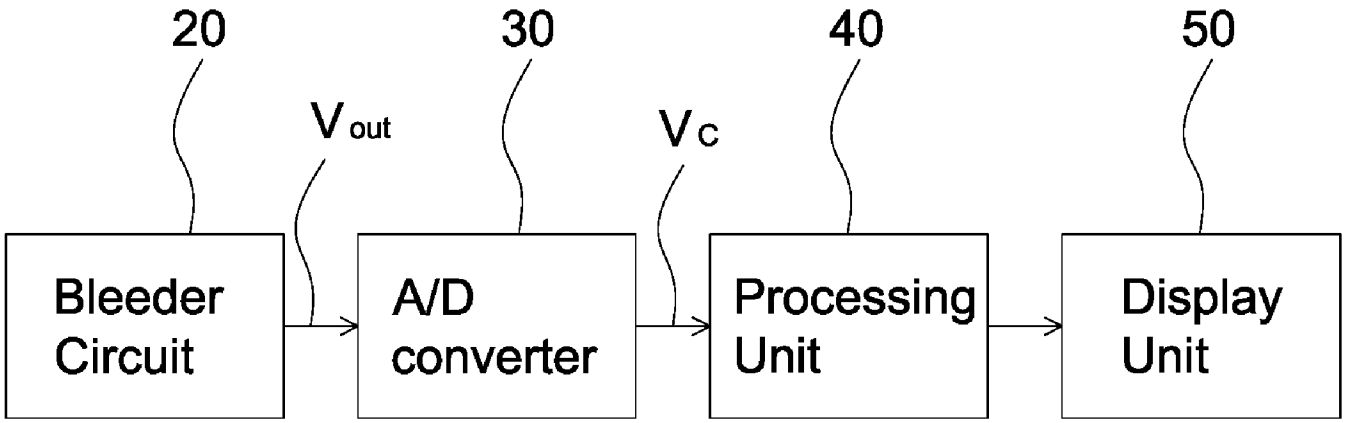
FIG. 3 is a block diagram of the bleeder circuit, a A/D converter, a processing unit and a display unit of the first embodiment of the invention.

Referring to FIG. 3, the output voltage $V_{out}$ is converted to a numeral value $V_c$ through an A/D converter 30. The numeral value $V_c$ can be represented by following equation (2):

$V_c = V_{out} \times 2^n / V_{Ref}$ . . . (2), wherein n is resolution of the A/D converter 30, and $V_{Ref}$ is reference voltage of the A/D converter 30.

Assuming the resolution n is 10, and the reference voltage $V_{Ref}$ is substantially 1.5±5% volts, that is, the reference voltage $V_{Ref}$ substantially ranges from 1.425 to 1.575 volts. The A/D converter 30 is configured to convert the output voltage $V_{out}$ to the numeral value $V_c$ for an output to the processing unit 40. After converting a number of times, a conversion table (referring to Table 1) between the output voltage $V_{out}$, the numeral value $V_c$, and the number of rotation are obtained. Referring to Table 1, the conversion table shows the number of rotation and the corresponding numeral values $V_c$. The conversion table is stored in the processing unit 40. The processing unit 40 receives the numeral value $V_c$, judges the number of rotation of the compensating device 100 (that is, the number of rotation of the adjusting cap 10 in the circumferential direction or the movement of the adjusting screw 143 in the axial direction) by means of table lookup according to magnitude of the numeral value $V_c$ and controls the display unit 50 to display the number of rotation. It is worth noting that the processing unit 40 can judge the number of rotation of the compensation device 100 by interpolation when the numeral value $V_c$ received by the processing unit 40 falls outside the predetermined ranges of the numeral value $V_c$ of the conversion table.

TABLE 1

| | Output Voltage $V_{out}$ (volt) | | | | | |
|---|---|---|---|---|---|---|
| | 0.0061-0.0104 | 0.0594-0.0987 | 0.1914-0.3055 | 0.4527-0.6714 | 0.8429-1.1302 | 1.3354-1.5972 |
| Numeral Value $V_c$ | 4-7 | 39-71 | 124-219 | 294-485 | 547-811 | 867-1147 |
| Number of Rotation | 2 | 3 | 4 | 5 | 6 | 7 |

It is worth noting that the resistance $R_{121}$ of the first resistor 121 can be selectively determined to correspond to the number of rotation of the adjusting cap 10 for preventing an erroneous judgment by the processing unit 40. It works because two resistances $R_{121}$ corresponding to two adjacent numbers of rotation (e.g. 2 and 3) can be set as two discontinuous numeral values. For example, the resistance $R_{121}$ of the first resistor 121 is set as 0.1K±20% Ohms (that is, the resistance $R_{121}$ of the first resistor 121 ranges from 0.08K to 0.12K Ohms) when the number of rotation of the adjusting cap 10 is 2 (two turns), and the resistance $R_{121}$ of the first resistor 121 is set as 1K±20% Ohms (that is, the resistance $R_{121}$ of the first resistor 121 ranges from 0.8K to 1.2K Ohms) when the number of rotation of the adjusting cap 10 is 3 (three turns). Since the range of the resistance $R_{121}$ corresponding to two turns of the adjusting cap 10 does not overlap that corresponding to three turns, the corresponding output voltages $V_{out}$ cannot be overlapped. Therefore, the possibility of erroneous judgment by the processing unit 40 can be reduced.

In the first embodiment, the axial direction is a direction in which the adjusting screw 143 of the adjusting unit 14 is moved by the adjusting cap 10. The axial direction is also a direction in which the adjusting screw 143 pushes against the inner lens barrel. The circumferential direction is a circumferential direction of the adjusting cap 10.

In the prior art, when the sight is not powered and the adjusting cap is accidentally rotated over 360 degrees, the user cannot be aware of the change of the number of rotation. The user cannot still recognize the change of the number of rotation even if the sight is powered afterwards, because the judgment of number of rotation is based on the movement of the adjusting cap in the circumferential direction. It is worth noting that the invention avoids the above described problem by detecting the movement of the adjusting screw 143 in the axial direction. In the first embodiment, when the sight is not powered (that is, the input voltage $V_{in}$ is 0 volts), although the processing unit 40 cannot judge the number of rotation of the compensating device 100, the contact point between the coil 127 and the first resistor 121 is axially changed during the rotation of the adjusting cap 10. Therefore, the output voltage $V_{out}$ is outputted (by the converting unit 12) according to the resistances of the first resistor 121 and the second resistor 203 after the sight is powered. The processing unit 40 then judges the number of rotation of the compensating device 100 by means of table lookup according to the magnitude of the output voltage $V_{out}$. In other words, even if the user accidentally changes the number of rotation in a condition that the sight is not powered, the sight is capable of displaying the changed number of rotation of the compensating device 100 after being powered. Therefore, the operation of the sight is intuitive and convenient for the user.

Figure 4:
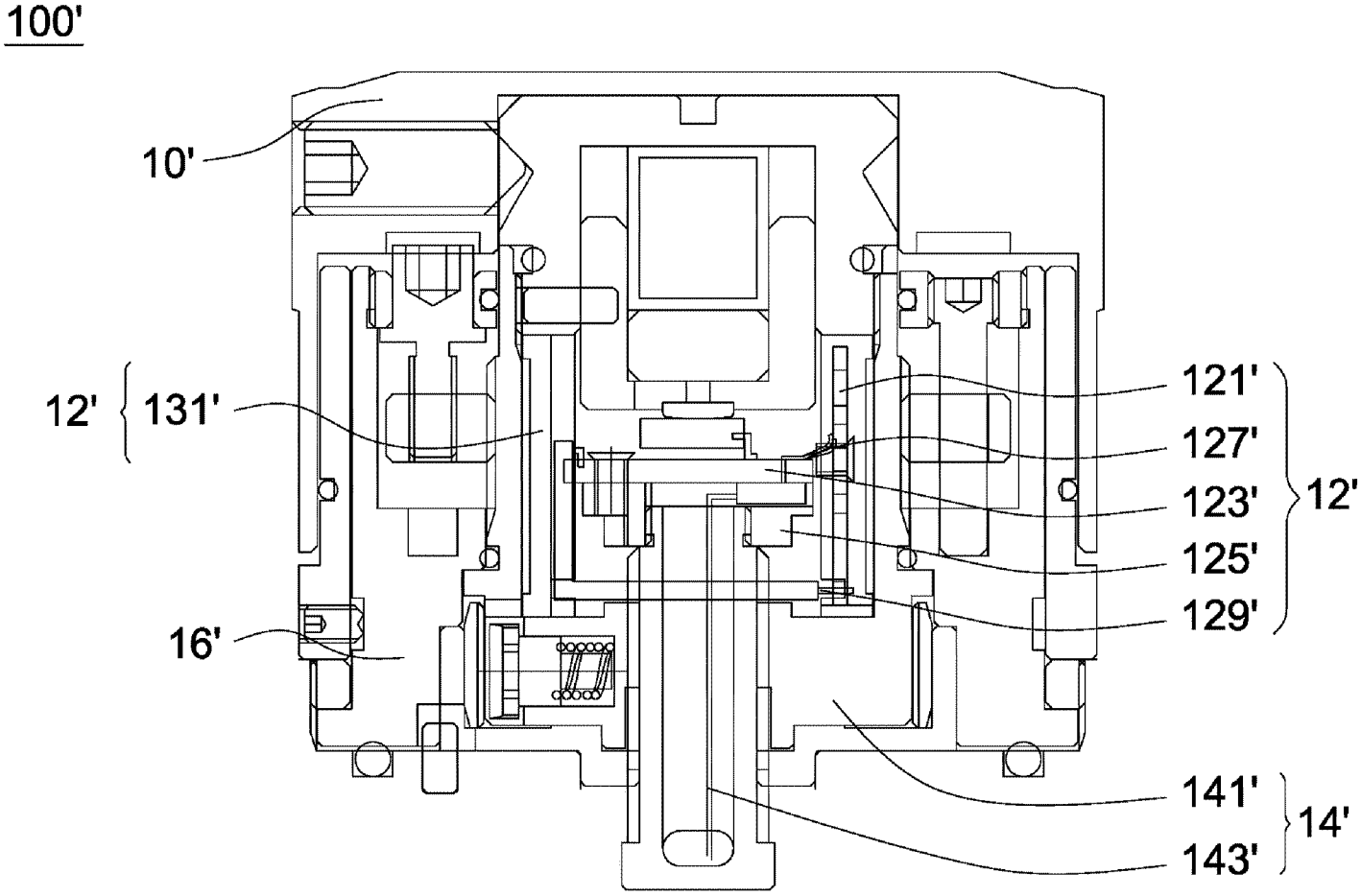
FIG. 4 is a sectional view of a compensating device of a sight in accordance with a second embodiment of the invention.

Referring to FIG. 4, a sight (not shown) in accordance with a second embodiment of the invention includes a main body (not shown), a compensating device 100', an objective unit (not shown), an eyepiece unit (not shown), an inner lens barrel (not shown), a converting unit 12', a display unit (not shown), a processing unit (not shown) and an elastic member (not shown). The compensating device 100' includes an adjusting cap 10', an adjusting unit 14' and a base 16'. The converting unit 12' includes a first resistor 121', a circuit board 123', a support base 125', a metallic strip 127', a conductive wire 129' and a sleeve 131', wherein the metallic strip 127' is fixed on the circuit board 123' by welding and is placed against the first resistor 121'. The arrangement of other elements and operation are similar to those of the above embodiment, and therefore the descriptions thereof are omitted.

A sight (not shown) in accordance with a third embodiment of the invention includes a main body (not shown), a compensating device (not shown), an objective unit (not shown), an eyepiece unit (not shown), an inner lens barrel (not shown), a converting unit (not shown), a display unit (not shown), a processing unit (not shown) and an elastic member (not shown). The compensating device includes an adjusting cap, an adjusting unit and a base. The converting unit includes a first resistor, a circuit board, a support base, a first coil, a second coil and a sleeve, wherein the first coil is fixed on a first surface (e.g. a surface to which the coil 127 of the FIG. 1 is fixed) of the circuit board by welding and is placed against the first resistor, and the second coil is fixed to both a second surface of the circuit board and the first resistor. During the operation, a contact point between the first coil and the first resistor is changed as the adjusting unit is moved with respect to the base, and a contact point between the second coil and the first resistor is fixed. The arrangement of other elements and operation are similar to those of the above embodiment, and therefore the descriptions thereof are omitted.

In brief, the circuit board 123, 123' can be connected to the first resistor 121, 121' by the coil 127, the metallic strip 127', the conductive wire 129, 129' or other conductive member, so as to constitute the bleeder circuit 20.

In the above embodiments, the circuit board 123, 123' may be a PCB (Printed Circuit Board), the processing unit 40 may be a MCU (Micro Control Unit), and the display unit 50 may be a LCD (Liquid Crystal Display), OLED (Organic Liquid Crystal Display) or AMOLED (Active Matrix Organic Liquid Crystal Display).

Figure 5:
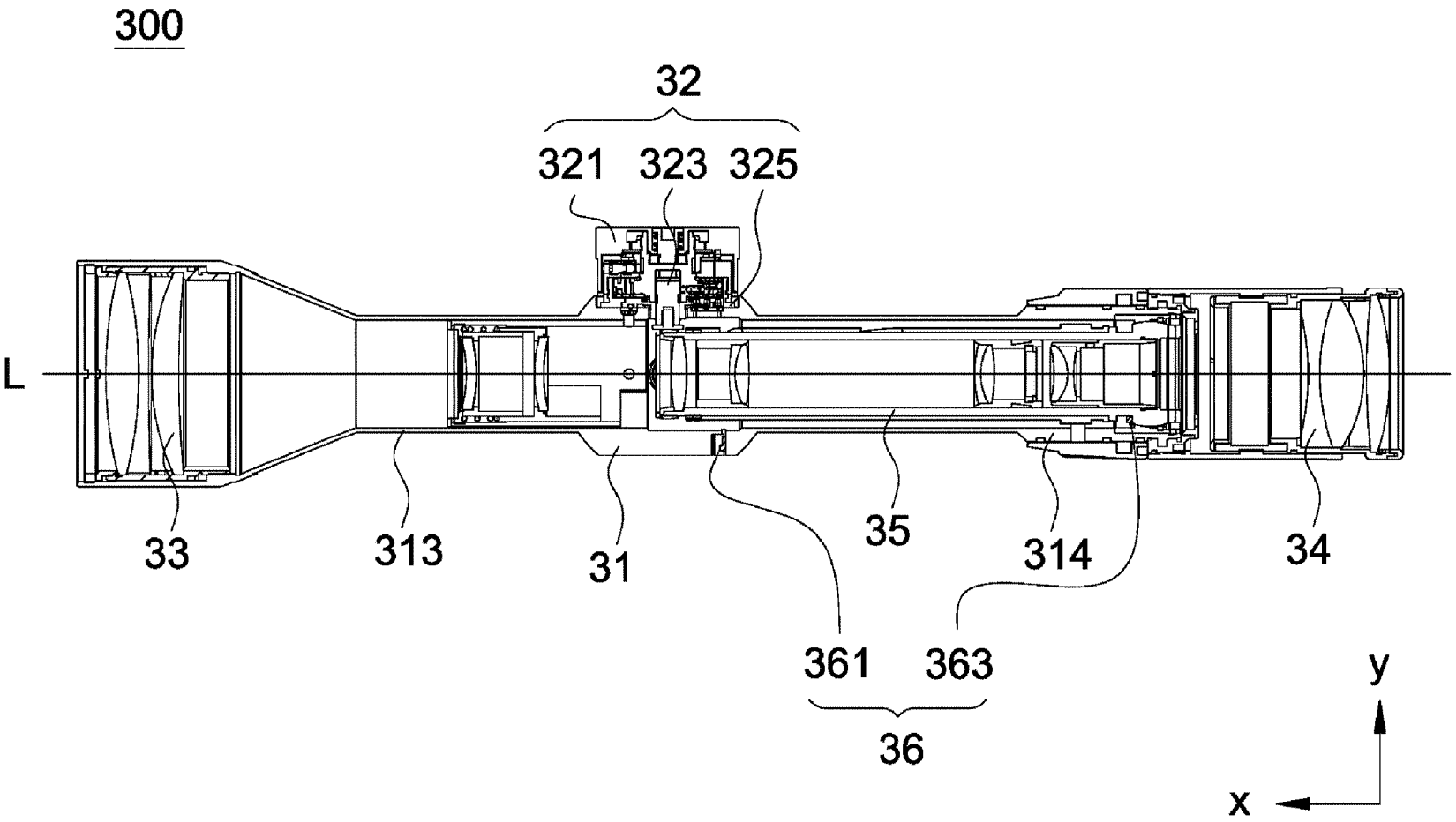
FIG. 5 is a sectional view of a sight in accordance with a fourth embodiment of the invention.

Referring to FIG. 5, a sight 300 in accordance with a fourth embodiment of the invention includes a main body 31, a compensating device 32, an objective unit 33, an eyepiece unit 34, an inner lens barrel 35, a converting unit 36, a display unit (not shown), a processing unit (not shown) and an elastic member (not shown).

The main body 31 has a frontal end portion 313 and a rear end portion 314, the objective unit 33 is connected to the frontal end portion 313, and the eyepiece unit 34 is connected to the rear end portion 314. The inner lens barrel 35 is disposed in the main body 31, is between the objective unit 33 and the eyepiece unit 34, and includes a plurality of lenses. The objective unit 33, the inner lens barrel 35 and the eyepiece unit 34 constitute an optical axis L. The elastic member is disposed in the main body 31 and is placed against the inner lens barrel 35. The compensating device 32 is disposed on the main body 31, penetrated into the main body 31 and placed against the inner lens barrel 35 so as to adjust the optical axis L. In the fourth embodiment, the compensating device 32 is an elevation compensating device or a windage compensating device, the elevation compensating device is usually disposed on a top side of the main body 31, and the windage compensating device is usually disposed on a right side or a left side of the main body 31.

The compensating device 32 includes an adjusting cap 321, an adjusting unit 323 and a base 325. The base 325 is disposed on the main body 31. The adjusting unit 323 is rotatably disposed on the base 325, penetrated through the base 325 and placed against the inner lens barrel 35. The adjusting cap 321 is connected to the adjusting unit 323, and the adjusting cap 321 is rotated for rotating and moving the adjusting unit 323, so that the adjusting unit 323 can move the inner lens barrel 35.

The converting unit 36 includes a first sensor 363 and a second sensor 361. The second sensor 361 is disposed on the main body 31 and is configured to detect a variation in an angle of the main body 31 of the sight 300 and output an electric signal corresponding to the variation. The first sensor 363 is disposed on the inner lens barrel 35 and is configured to detect a variation in an angle of the inner lens barrel 35 and output an electric signal corresponding to the variation. In the fourth embodiment, the first sensor 363 and the second sensor 361 are gyros.

Figure 6:
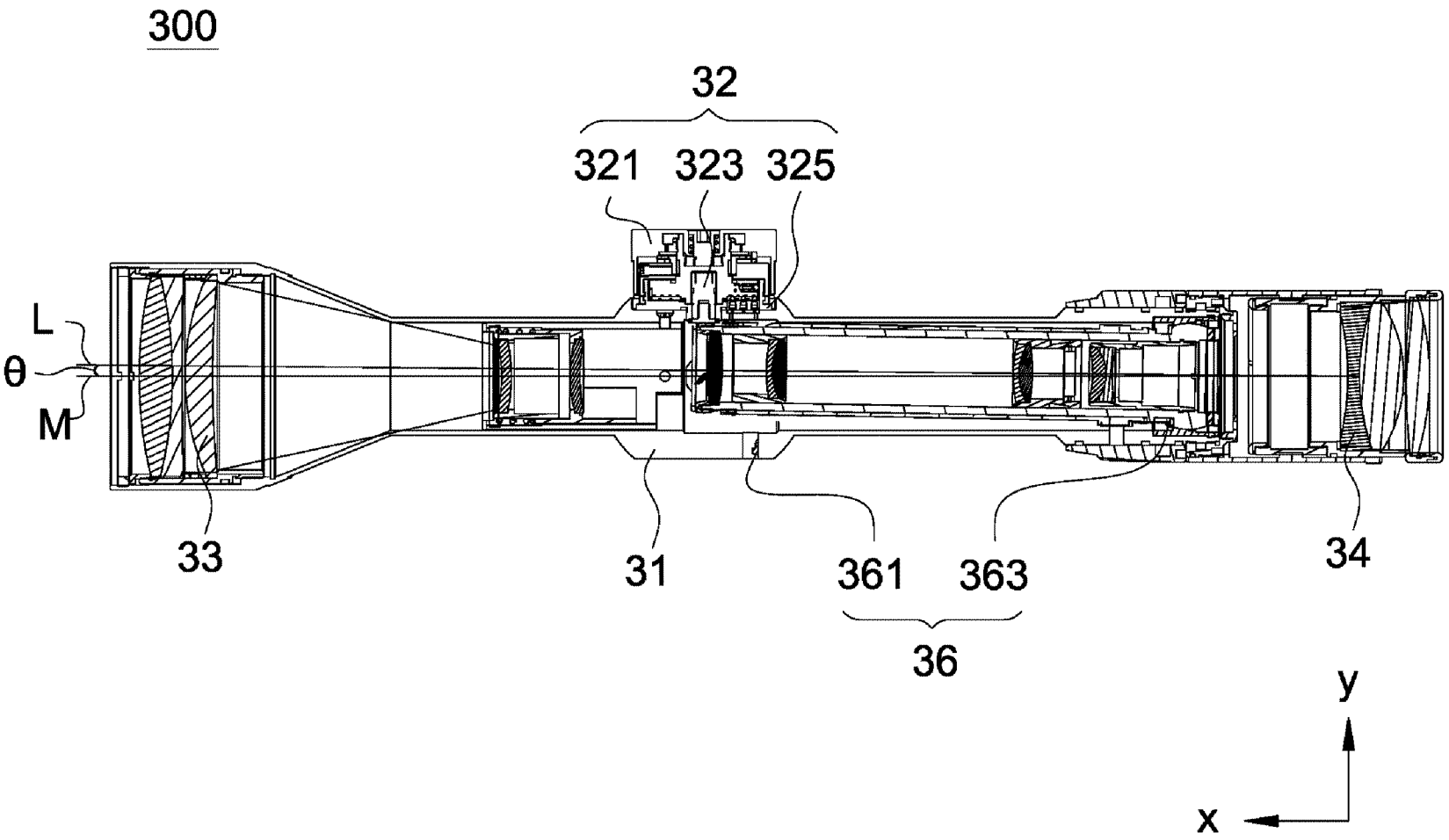
FIG. 6 is a sectional view of the sight of FIG. 5 during operation.

Referring to FIG. 6, during operation of the compensating device 32 for correcting bullet impact points, the adjusting cap 321 is rotated in a circumferential direction for rotating the adjusting unit 323 with respect to the base 325, so that the adjusting unit 323 is moved in an axial direction (e.g. a Y-direction shown in FIG. 6) with respect to the base 325. Meanwhile, the inner lens barrel 35 placed against the adjusting unit 323 is rotated with respect to the main body 31. The first sensor 363 detects an angle of the inner lens barrel 35 and outputs a first inclination signal (not shown), and the second sensor 361 detects an angle of the main body 31 and outputs a second inclination signal (not shown). The processing unit receives the first inclination signal and the second inclination signal for obtaining the angles of the inner lens barrel 35 and the main body 31, calculates a relative angle θ of the inner lens barrel 35 with respect to the main body 31, and judges number of rotation of the compensating device 32 (that is, number of rotation of the adjusting cap 321 in the circumferential direction) by means of table lookup according to magnitude of the relative angle θ. Then, the processing unit controls the display unit to display the number of rotation. In the fourth embodiment, the relative angle θ is an angle at which the optical axis L of the inner lens barrel 35 is inclined with respect to a central axis M of the main body 31.

Moreover, during operation of the sight 300, the main body 31 of the sight 300 may be incidentally inclined because of movement of the user. Therefore, the inner lens barrel is inclined because the main body 31 is inclined, even if the inner lens barrel 35 is not rotated with respect to the main body 31. In such condition, if the sight is only provided with one sensor, the processing unit may erroneously judge the number of rotation. The sight 300 of the invention is provided with the first sensor 363 and the second sensor 361 for detecting the angles of the inner lens barrel 35 and the main body 31 as well as subtracting the angle of the main body 31 from the angle of the inner lens barrel 35, so as to reduce the effect of human factor.

In an example, the main body 31 is not inclined. After the adjusting cap 321 is rotated, the adjusting unit 323 is moved 0.3 mm in the Y-direction (as shown in FIG. 6), so that the inner lens barrel 35 is rotated by 0.19 degrees with respect to the main body 31. The processing unit receives the first inclination signal outputted by the first sensor 363 for obtaining that the angle of the inner lens barrel 35 is 0.19 degrees as well as receives the second inclination signal outputted by the second sensor 361 for obtaining that the angle of the main body 31 is 0 degrees. Then, the processing unit subtracts the angle of the main body 31 from the angle of the inner lens barrel 35 for obtaining that the relative angle θ of the inner lens barrel 35 with respect to the main body 31 is 0.19 degrees. Finally, the processing unit judges that the number of rotation of the compensating device 32 is 1 by means of table lookup according to magnitude of the relative angle θ.

In another example, the main body 31 is inclined, wherein the main body 31 is inclined by 1.2 degrees with respect to an axis (not shown) parallel to an X-direction (as shown in FIG. 6) during the operation. After the adjusting cap 321 is rotated, the adjusting unit 323 is moved 0.6 mm in the axial direction, so that the inner lens barrel 35 is rotated by 1.58 degrees with respect to the main body 31. The processing unit receives the first inclination signal outputted by the first sensor 363 for obtaining that the angle of the inner lens barrel 35 is 1.58 degrees as well as receives the second inclination signal outputted by the second sensor 361 for obtaining that the angle of the main body 31 is 1.2 degrees. Then, the processing unit subtracts the angle of the main body 31 from the angle of the inner lens barrel 35 for obtaining that the relative angle θ of the inner lens barrel 35 with respect to the main body 31 is 0.38 degrees. The processing unit judges that the number of rotation of the compensating device 32 is 2 by means of table lookup according to magnitude of the relative angle θ.

In a condition that the sight 300 is not powered, the user cannot view the number of rotation of the compensating device 32 by the display unit. In the invention, the user can observe an object (not shown) by the sight 300 and correct bullet impact points by the compensating device 32 no matter if the sight 300 is powered. When the sight 300 is not powered, the user can still operate the sight 300 in conventional way although the user fails to obtain the number of rotation of the compensating device 32. That is because the inner lens barrel is inclined during the rotation of the adjusting cap 321. After the sight 300 is powered, the first sensor 363 and the second sensor 361 immediately detect the angles of the inner lens barrel 35 and the main body 31 and output the first inclination signal and the second inclination signal, so that the processing unit calculates the relative angle θ and judges the number of rotation of the compensating device 32. In other words, even if the user changes the number of rotation of the compensating device 32 when the sight 300 is not powered, the sight 300 is capable of displaying the changed number of rotation of the compensating device 32 after being powered. Therefore, the operation of the sight is intuitive and convenient for the user.

What is claimed is:

1. A sight, comprising:

an inner lens barrel comprising a plurality of lenses, wherein the lenses constitute an optical axis;

a compensating device comprising:

a base;

an adjusting unit disposed on the base, penetrated through the base and placed against the inner lens barrel; and an adjusting cap connected to the adjusting unit, wherein the adjusting cap is rotated for axially moving the adjusting unit, and the inner lens barrel is pushed by the adjusting unit so that the optical axis is shifted; and a converting unit configured to convert shift amount of the optical axis to an electric signal corresponding to number of rotation of the adjusting cap and output the electric signal.

2. The sight as claimed in claim 1, wherein the converting unit is connected to the adjusting unit and is configured to convert axial movement of the adjusting unit to the electric signal.

3. The sight as claimed in claim 2, wherein the converting unit comprises a first conductive member and a first resistor, the first conductive member is placed against the first resistor, and a contact point between the first conductive member and the first resistor is changed during the movement of the adjusting unit.

4. The sight as claimed in claim 3, wherein when the contact point between the first conductive member and the first resistor is changed, the resistance of the first resistor is changed in the range of OK to 118.8K Ohms.

5. The sight as claimed in claim 3, wherein the adjusting unit comprises a transmitting member and an adjusting screw, the first resistor is disposed on the transmitting member, and the first conductive member is connected to the adjusting screw.

6. The sight as claimed in claim 5, wherein the converting unit further comprises a circuit board connected to the adjusting screw, and the first conductive member is fixed on the circuit board.

7. The sight as claimed in claim 6, wherein the converting unit further comprises a support base disposed on the adjusting screw and configured to carry the circuit board.

8. The sight as claimed in claim 6, wherein the converting unit further comprises a second conductive member fixed to both the circuit board and the first resistor.

9. The sight as claimed in claim 5, wherein the converting unit further comprises a sleeve disposed on the transmitting member, and the first resistor is disposed on the sleeve.

10. The sight as claimed in claim 2, further comprising:

a main body having a frontal end portion and a rear end portion;

an objective unit connected to the frontal end portion;

an eyepiece unit connected to the rear end portion; and an elastic member disposed in the main body and placed against the inner lens barrel;

wherein the inner lens barrel disposed in the main body, between the objective unit and the eyepiece unit, and the objective unit, the inner lens barrel and the eyepiece unit constitute the optical axis;

wherein the compensating device is disposed on the main body and is placed against the inner lens barrel for adjusting the optical axis.

11. The sight as claimed in claim 1, wherein the adjusting cap is rotated for axially moving the adjusting unit so as to adjust an angle of the inner lens barrel, and the converting unit is configured to convert variation in the angle of the inner lens barrel to the electric signal.

12. The sight as claimed in claim 11, further comprising a main body, wherein the inner lens barrel is disposed in the main body.

13. The sight as claimed in claim 12, wherein the converting unit comprises a first sensor and a second sensor, the first sensor is disposed on the inner lens barrel and is configured to detect the angle of the inner lens barrel and output a first inclination signal, and the second sensor is disposed on the main body and is configured to detect an angle of the main body and output a second inclination signal.

14. The sight as claimed in claim 13, wherein the first sensor and the second sensor are gyros.

15. The sight as claimed in claim 13, further comprising a processing unit, wherein the processing unit is configured to receive the first inclination signal and the second inclination signal for obtaining the angles of the inner lens barrel and the main body, calculate a relative angle and judge the number of rotation of the adjusting cap according to magnitude of the relative angle.

16. The sight as claimed in claim 15, wherein the processing unit subtracts the angle of the main body from the angle of the inner lens barrel for obtaining the relative angle.

17. The sight as claimed in claim 15, further comprising a display unit, wherein the processing unit is configured to control the display unit to display the number of rotation of the adjusting cap.

18. The sight as claimed in claim 12, further comprising an objective unit and an eyepiece unit, wherein the main body has a frontal end portion and a rear end portion, the objective unit is connected to the frontal end portion, and the eyepiece unit is connected to the rear end portion.

19. The sight as claimed in claim 18, wherein the inner lens barrel is between the objective unit and the eyepiece unit and constitutes an optical axis with the objective unit and the eyepiece unit, and the compensating device is disposed on the main body and is placed against the inner lens barrel for adjusting the optical axis.

20. The sight as claimed in claim 12, further comprising an elastic member disposed in the main body and placed against the inner lens barrel.

* * * * *